US005425447A

United States Patent [19]

Farina

[11] Patent Number: 5,425,447

[45] Date of Patent: Jun. 20, 1995

[54] BAG FOR CONTAINING AT LEAST TWO SEPARATE SUBSTANCES THAT ARE TO BE MIXED

[75] Inventor: Italia Farina, Verona, Italy

[73] Assignee: S.I.F.RA. Societa Italiana Farmaceutici Ravizza S.p.A., Isola Della Scala, Italy

[21] Appl. No.: 148,002

[22] Filed: Nov. 5, 1993

[30] Foreign Application Priority Data

Nov. 6, 1992 [IT] Italy ..... TO92A0908

[51] Int. Cl.[6] ..... B65D 25/08

[52] U.S. Cl. ..... 206/219; 206/221; 383/88

[58] Field of Search ..... 206/219, 221, 438; 383/35, 88, 89, 90

[56] References Cited

U.S. PATENT DOCUMENTS

| | | | |
|---|---|---|---|
| 2,663,298 | 12/1953 | Rose . | |
| 2,756,874 | 7/1956 | Erickson et al. | 206/221 |
| 3,149,943 | 9/1964 | Amador | 206/221 |
| 3,272,324 | 9/1966 | Schneider et al. | 206/221 |
| 3,462,070 | 8/1969 | Corella | 206/221 |
| 3,478,871 | 11/1969 | Sager . | |

FOREIGN PATENT DOCUMENTS

| | | | |
|---|---|---|---|
| 1196099 | 11/1959 | France . | |
| 721455 | 1/1955 | United Kingdom | 206/221 |
| 762607 | 11/1956 | United Kingdom . | |
| 8103009 | 10/1981 | WIPO . | |

*Primary Examiner*—David T. Fidei
*Attorney, Agent, or Firm*—Dvorak and Traub

[57] ABSTRACT

The bag is formed from two layers of a plastic having properties of mutual superficial adhesion. The layers are laid one on top of the other, and define between themselves at least two chambers each containing a different liquid. To simplify the operations of manufacturing and using the bag, without contaminating the liquids contained in the chambers, the chambers are separated from each other by a separating septum formed by a section of mutual adhesion of the two layers, in which the two layers are in intimate superficial contact. The adherent section is bounded by two lines where the layers are folded to define throttle lines which prevent the liquids from getting from the two chambers into the adherent section. To use the bag, the bag is simply unfolded and pressure is applied to the chambers, in such a way as to cause the layers to come apart in the adherent section and the liquids to mix.

5 Claims, 2 Drawing Sheets

BAG FOR CONTAINING AT LEAST TWO SEPARATE SUBSTANCES THAT ARE TO BE MIXED

BACKGROUND OF THE INVENTION

The present invention relates to a bag for containing two separate substances that are to be mixed.

Though, hereinafter, specific reference is made to a bag containing two different fluids to be mixed, the present invention also applies to a bag containing a fluid and a powder, granulated substance, or any other mixing substance, typically for pharmaceutical use.

As is well known, there are many substances in the medical field that have to be used simultaneously with each other or actually mixed together in order to obtain the desired therapeutic and/or diagnostic effects, but that cannot be mixed prior to the moment of use since they would then lose all or at least some of their efficacy or would otherwise undergo undesirable changes.

A typical example is bags containing a solution for dialysis, replacement or infusion purposes containing calcium salts and bicarbonate which, if mixed before being packed, during high-temperature sterilisation, react to form insoluble calcium carbonate which cannot then be infused into the patient.

To solve this problem, tubular plastic bags have been proposed containing two or more chambers separate from each other, generally by means of weld lines. Between each pair of chambers there is also a communication channel or hole which is sealed by a breakable valve which when suitably flexed or compressed by the user breaks, allowing the liquids inside to move between the chambers and mix together.

This solution does however have drawbacks which have greatly limited its use. In the first place, this bag requires long mixing times, and proper mixing of the liquids in the respective chambers cannot be achieved. This is because the liquids can only migrate through the communication channels or holes, and the cross section of these is limited. Consequently only a small amount of liquid per unit time manages to pass from one chamber to the other, and a fairly considerable amount of time is needed to allow all the liquid in one chamber to pass into another. In addition to this it is not always possible to transfer all the liquid from one chamber into another in a single pass, owing to the capacity of the other chamber, and it then becomes necessary to pour the liquid in both directions some number of times before mixing is complete. As these processes have to be performed by compressing one or other chamber as appropriate, thorough mixing requires long, fatiguing manipulations; often, therefore, the operator will cut these short with mixing still incomplete and the liquids not yet uniformly mixed, and the concentration of the various active components may therefore be left out of balance, with harmful consequences on the intended treatment.

Furthermore it is no easy matter to break the valve and this part of the operation may in some cases itself require complex and repeated manipulation of the bag by the user, making the whole liquid mixing process problematical.

To solve this problem, another suggestion already made has been to separate the various chambers by means of weak weld lines, that is lines in which the weld is made "lighter" so that the weld breaks when pressure is applied to at least one chamber. However, this solution is also unsatisfactory: the weak weld is very difficult to make as it requires great attention to welding times and parameters to avoid making either an inadequate weld (which will not guarantee the separation of the liquids in the different chambers) or too strong a weld (which could result in the bag itself breaking or other welds coming apart, for example along the edges of the bag, and liquid escaping).

Still more significantly, when the weld is being broken fragments or particles of the weak weld may come loose from the bag and contaminate the liquid, which would thereby be seriously compromised.

SUMMARY OF THE INVENTION

The object of the present invention is to provide a containing bag that will overcome the problems encountered with bags of known type, and that can therefore guarantee the separation of the two substances that are to be mixed during filling and storage of the bag, but that will permit simple, quick and complete mixing of the substances at the time of use without jeopardising the mixing.

According to the present invention, a bag is provided for containing at least two separate substances that are to be mixed, comprising at least two layers of a plastic having properties of mutual superficial adhesion, said layers being laid one on top of the other and defining between themselves at least two chambers each containing a different substance, said containing chambers being separated from each other by a separating septum, characterised in that said separating septum is formed by a section of mutual adhesion of said two layers, in which said two layers are in intimate superficial contact, said section being bounded by closing means interposed between this section and said two containing chambers.

The invention relates also to a method of making the bag.

The invention is based on the observation that the material from which bags of the indicated type are usually made has adhesive properties whereby the two layers or sides forming the greater surfaces of the bag adhere naturally to each other, and that this adhesion can be exploited to create a zone of separation between the two chambers, without making welds. Closing means are also provided to guarantee that the liquid contained in the bags cannot penetrate the zone of separation in the long term. These closing means are preferably two 180° folds of the bag to form a general Z shape, in such a way that the section of separation is compressed between the two chambers and the folds define throttle points through which the substances cannot pass. When it is necessary to mix the two substances, it is a simple matter to remove the closing means—in particular, unfold the bag—and apply slight pressure to the two chambers. In this way the pressure of the substances causes the two sheets or sides in the section of separation to come apart and form a single chamber inside the bag. In this way the two substances can be mixed easily and quickly, and it is easy for the operator to obtain thorough and uniform mixing.

BRIEF DESCRIPTION OF THE DRAWINGS

To furnish a better understanding of the present invention, there is now described a preferred embodiment thereof purely by way of a non-restricting example, with reference to the accompanying drawings in which.

DETAILED DESCRIPTION OF THE INVENTION

The bag according to the present invention is made from a tubular web which is already in common use for making bags for pharmaceutical use and is commercially available. In detail, the web is made of an extruded and compressed plastic having properties of superficial adhesion. For pharmaceutical use in particular, polypropylene and polyethylene are suitable (and already used): these, in addition to the necessary adhesive properties, have the necessary characteristics required for this specific use. These materials, during the making of the tubular web, develop cross linking bonds between the two superimposed surfaces, giving rise to the adhesive property referred to above. However, in bags of the prior art this property was not exploited and was even considered somewhat disadvantageous, inasmuch as it required suitable means to separate the two sides of the tubular web, when necessary.

Figure 1:
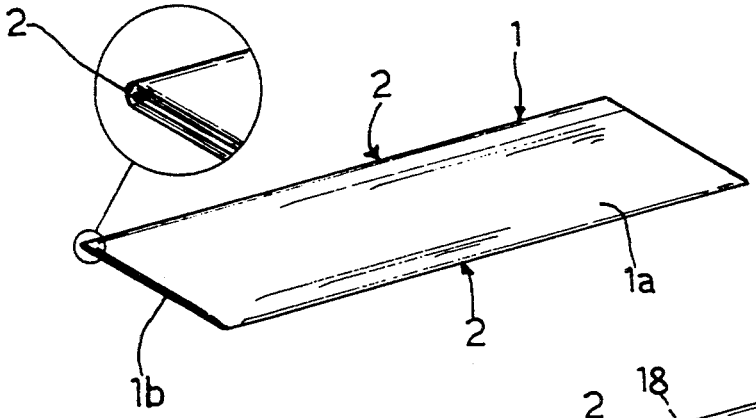
FIGS. 1 to 8 show different stages in the making and use of the bag according to the invention.

In a known manner, the web is cut to the desired length, in such a way as to produce a portion or piece of web, as shown in FIG. 1 and indicated by the numeral 1. As FIG. 1 also shows, the portion of web 1 has two main sides or layers, 1*a* and 1*b* respectively, connected together along their longitudinal edges 2, as shown in the enlarged detail in which, for reasons of illustrative clarity and in contrast to what occurs in reality, the two layers 1*a* and 1*b* are shown separate from each other. Actually, owing to the adhesive property of the material employed, the two layers 1*a* and 1*b* of the portion of web 1 adhere strongly to each other.

Figure 2:
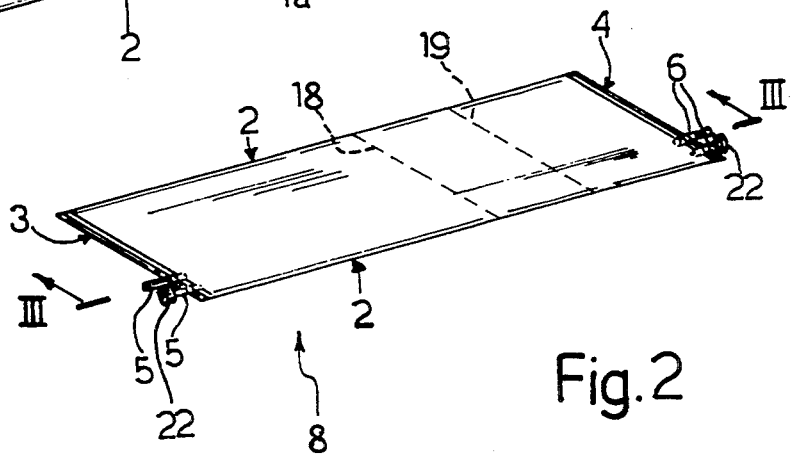

Next, in a known manner, between the transverse edges 3, 4 of the layers 1*a*, 1*b*, which for this purpose are slightly separated from each other, short tubes are inserted 5, 6, respectively. The transverse edges 3 and 4 are then welded and optionally also the longitudinal edges 2. This gives the intermediate bag 8 shown in FIG. 2 which is closed around all four edges and whose interior is accessible only through the tubes 5 and 6.

Figure 3:
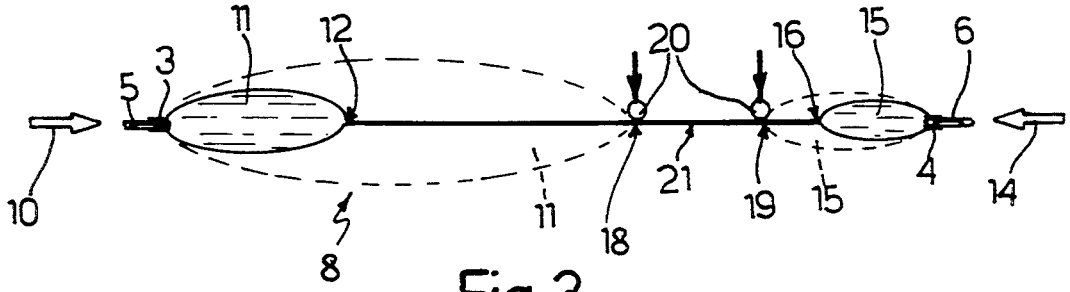

Next, the two liquids are injected through the tubes 5 and 6. More specifically, a first liquid 10 is injected through the tubes 5 (or through at least one of the tubes 5) and flows into the web portion 1, causing the two layers 1*a* and 1*b* to come apart beginning at the area nearest the tubes 5 themselves. This creates a first chamber 11 which gradually increases in volume beginning at the transverse edge 3 and has an advancing front (whose line is shown in FIG. 3 and is indicated diagrammatically by 12) which moves gradually towards the opposite transverse edge 4. In the same way a second liquid 14 is injected through the tubes 6, and as it penetrates the interior of the web portion 1 it causes the two layers 1*a* and 1*b* to come apart beginning at the area nearest the tubes 6. This creates a second chamber 15 which gradually increases in volume beginning at the transverse edge 4 and has an advancing front (whose line is indicated diagrammatically by 16) which moves gradually towards the opposite transverse edge 3. By controlling the pressure at which the liquids are injected, it is possible to move the advancing fronts 12, 16 steadily through the chambers and to interrupt the injection of the liquids 10 and 15 when the advancing fronts 12, 16 of the chambers 11, 15 have reached a respective predetermined cut-off line indicated diagrammatically by the broken lines 18 and 19 in FIG. 2.

Advantageously, it is possible to provide jaws or clamps, indicated diagrammatically by the numeral 20 in FIG. 3, which compress between themselves the two layers 1*a* and 1*b* or squeeze them against a supporting surface along the cut-off lines 18, 19, thereby ensuring that the liquids 10 and 15 advancing into the intermediate bag 8 cannot pass beyond the cut-off lines 18 and 19. Between the chambers 11 and 15 there is therefore a section 21 in which the two layers 1*a* and 1*b* still adhere strongly to each other so that there is no liquid present between them.

After this, the tubes 5, 6 are fitted with respective stoppers or other closure members 22 to prevent the newly introduced liquids from escaping.

Figure 4:
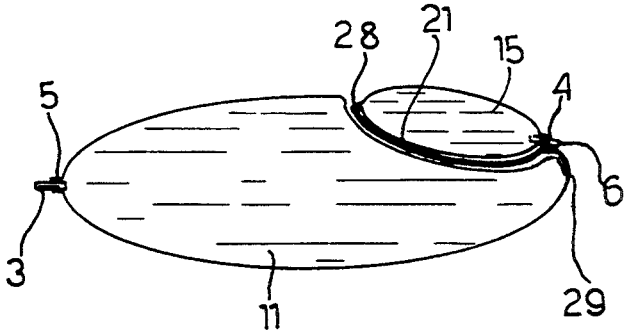

Next, the bag 8 is folded along the cut-off lines 18 and 19, in each case through 180° in a Z configuration. The folded bag is shown in FIG. 4, in which, as will be observed, the section 21 is squeezed between the walls of the chambers 11 and 15 and is bounded by throttle lines 28 and 29 (essentially coinciding with the cut-off lines 18, 19), which the liquids 10 and 14 cannot pass even if pressure is exerted on the chambers 11 and 15.

The bag 8 is then provided with means which prevent it from being accidentally unfolded prematurely, In the specific case illustrated, the bag 8 is completely covered with plastic sheets which adhere completely to the bag and are welded around the edges to form an external sealed covering 23. This method thus ensures not only that the folded configuration shown in FIG. 4 is maintained but also that the necessary protection is provided against the outside environment.

Figure 5:
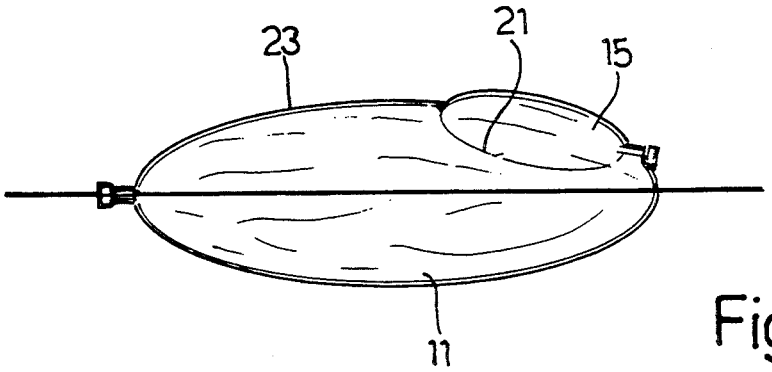
Figure 6:
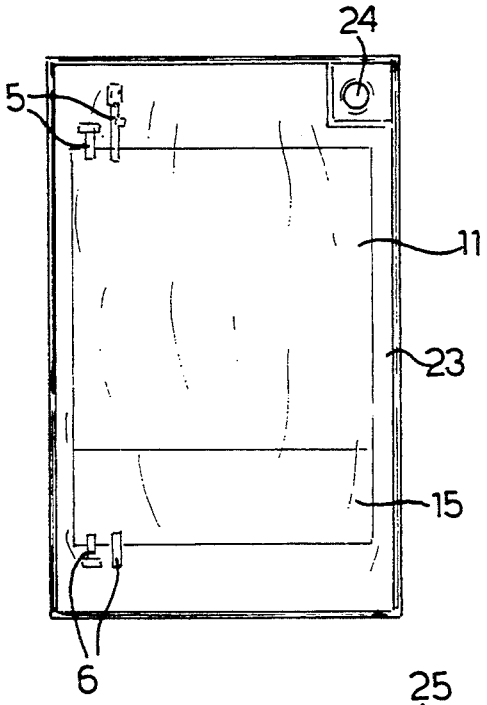

The result is the pack shown in FIGS. 5 and 6 in elevation and plan views respectively, which show the chambers 11 and 15, the section 21 compressed between them, the tubes 5 and 6 and the covering 23 which completely surrounds the entire bag 8. Apertures maybe made in the covering 23, for example at 24, or other structures to assist transport and manipulation of the pack.

Where necessary, as for the intended use, the necessary sterilisation of the bag is performed before or after folding.

Figure 7:
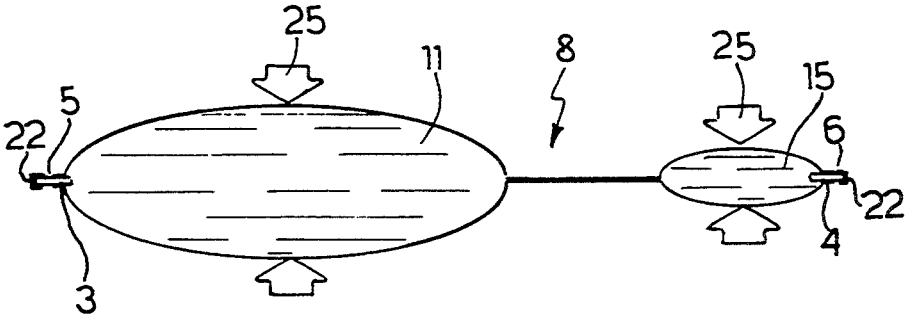
Figure 8:
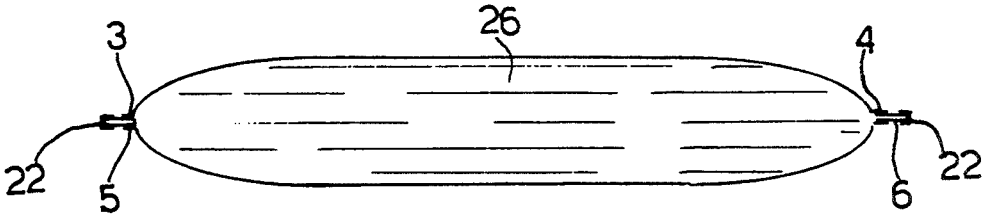

At the moment of use, when the two liquids 10 and 14 are to be mixed, the external covering 23 is removed by cutting it or tearing it off, and the bag 8 is opened out into the elongated position shown in FIG. 7. It is then sufficient to lay the bag 8 on a supporting surface (not shown) and apply pressure to either or both of the chambers 11, 15, as indicated diagrammatically in the same FIG. 7 by the arrows 25. The pressure of the liquids inside the chambers then causes the two sheets 1*a* and 1*b* to come apart even in the section 21 and to form a single large chamber 26 in which mixing can take place quickly and efficiently, because the liquids can use the entire cross-section of the chamber 26 through which to migrate and at all times have access to the entire internal volume of the bag 8. The bag 8 itself can then be used in the conventional manner for the intended therapeutic use.

The advantages of the bag described are as follows. In the first place it is extremely simple and economical to produce and requires no complex or critical operations such as the insertion of intermediate valves or the creation of weak welds. Furthermore the bag is much simpler to use than known bags inasmuch as it requires simple operations (opening out of the bag and pressing of even just one of the two chambers), and these operations are quick and can be performed without difficulty by anybody.

Furthermore, the liquids can be mixed easily and effectively without requiring prolonged manipulations, and this means that there is less risk of incomplete mixing. Lastly, there is no risk that the liquids can become contaminated because there are no foreign parts that might become detached from the bag: the present bag is therefore particularly applicable to medical and sanitary uses in general.

Finally, it will be clear that the bag and method of production here described and illustrated can be modified and variants made thereof without thereby departing from the protective scope of the present invention. In particular it should be emphasised that the present invention is applicable to bags even where these are made of different plastics from those indicated above for illustrative purposes, provided they have the requisite adhesive properties. Also, instead of using a tubular web, two webs each of a single layer could be laid on top of each other and then welded longitudinally. Again, the bag can be folded before the liquids are introduced, and these liquids may be injected simultaneously or one after the other. The outer packing may also differ from that described: in particular, where an external protective covering is not required it is possible to adopt any means for tying or bonding the transverse edges of the chambers 11 and 15 together.

I claim:

1. A bag for containing at least two separate substances that are to be mixed, comprising:

a first layer and a second layer (1*a*, 1*b*) of a plastic having a superficial adhesive property, said first and second layers being connected together along an edge portion to define at least two chambers (11, 15) between the first and second layers, each chamber containing a different substance, said chambers separated from each other by a section (21) of intimate superficial contact of said first and second layers in which only an inner surface of said first and second layers are mutually adhered to each;

a closable tube extending into each chamber, wherein each chamber is accessible only by the closable tube; and a cutoff line defining an interface between each of said chambers and said section of intimate superficial contact, wherein said bag has a single fold along each cutoff line, and said section of intimate superficial contact is compressed between the chambers.

2. The bag according to claim 1, characterised in that said first and second layers (1*a*, 1*b*) are made from the same plastic.

3. The bag according to claim 1, characterised in that the bag is completely covered with plastic sheets which adhere completely to the bag, and are welded around the edges to form an external sealed covering (23) which compresses said section of intimate superficial contact between said chambers (11, 15).

4. The bag according to claim 1, characterised in that said first and second layers are made from polypropylene.

5. The bag according to claim 1, characterised in that said first and second layers are made from polyethylene.

* * * * *